United States Patent [19]

Blanchard

[11] Patent Number: 5,039,962

[45] Date of Patent: Aug. 13, 1991

[54] DEVICE FOR THE COUPLING OF TWO MICROWAVE SIGNAL SOURCES WITH REDUCTION OF THE LOSS IN THE EVENT OF MALFUNCTIONING OF A SOURCE

[75] Inventor: Pierre Blanchard, Verrieres Le Buisson, France

[73] Assignee: Thomson - CSF, Puyeaux, France

[21] Appl. No.: 425,820

[22] Filed: Oct. 23, 1989

[30] Foreign Application Priority Data

Oct. 28, 1988 [FR] France ..... 88 14133

[51] Int. Cl.[5] ..... H01P 1/12; H01P 5/20

[52] U.S. Cl. ..... 333/106; 333/122

[58] Field of Search ..... 333/105–108, 333/122

[56] References Cited

U.S. PATENT DOCUMENTS 2,912,694 11/1959 Phillips, Jr. ..... 333/106 X

FOREIGN PATENT DOCUMENTS 0200520 11/1986 European Pat. Off. .
1766847 1/1971 Fed. Rep. of Germany .
1766269 9/1971 Fed. Rep. of Germany .
87/05155 8/1987 PCT Int'l Appl. .
718865 11/1954 United Kingdom ..... 333/106
1588228 4/1981 United Kingdom ..... 333/106

*Primary Examiner*—Paul Gensler
*Attorney, Agent, or Firm*—Roland Plottel

[57] ABSTRACT

The coupling device is of the plug-like switch type in which the plug has three internal conduits separated from one another. These internal conduits enable at least two of the other input conduits to be made to communicate with one another, depending on the angular position of the plug. A device such as this can be used to disconnect a malfunctioning emitter and thus prevent any loss of power.

2 Claims, 4 Drawing Sheets

DEVICE FOR THE COUPLING OF TWO MICROWAVE SIGNAL SOURCES WITH REDUCTION OF THE LOSS IN THE EVENT OF MALFUNCTIONING OF A SOURCE

BACKGROUND OF THE INVENTION

1. Field of the Invention

The invention concerns devices enabling the coupling of two sources of microwave signals, for example, two emitters in such a way as to add up the power that they have respectively.

2. Description of the Prior Art

In presently used radars, the emitter often consists of elementary emitters, which are grouped in sets of two or more emitters in order to obtain the requisite power. The grouping of two emitters is done by means of an appropriate coupler, such as a magic T junction, that enables the energy values of the signals applied to these inputs to be added up.

These couplers have the drawback wherein, when an emitter is malfunctioning the loss of output energy is greater than the reduction in power due to the malfunctioning emitter.

SUMMARY OF THE INVENTION

An aim of the present invention, therefore, is to make a device for the coupling of two emitters, by which only the power of the malfunctioning emitter is lost.

The invention pertains to a device for the coupling of two sources of microwave signals, comprising a fixed external part with two input conduits, each connected to a source, and two output conduits, one connected to a load and the other to a device for the using of the microwave signals, and a rotating cylindrical faucet-plug like element, hereinafter called a plug, within the external part in close contact with this external part, said plug having internal conduits that are separated from one another and have a shape such that, depending on the angular position of the plug with respect to the external part, they either enable the connection of both input conduits to the output conduit, so as to add up the respective power of the sources of microwave signals, or enable the connection of one of the input conduits that is connected to the properly functioning energy source to the signal-using output conduit so as to disconnect the input conduit connected to the malfunctioning source as well as the output conduit connected to the load.

BRIEF DESCRIPTION OF THE DRAWINGS

Other characteristics and advantages of the present invention will appear from the following description of a particular embodiment, said description being made with reference to the appended drawings wherein.

DESCRIPTION OF THE PREFERRED EMBODIMENTS

Figure 1:
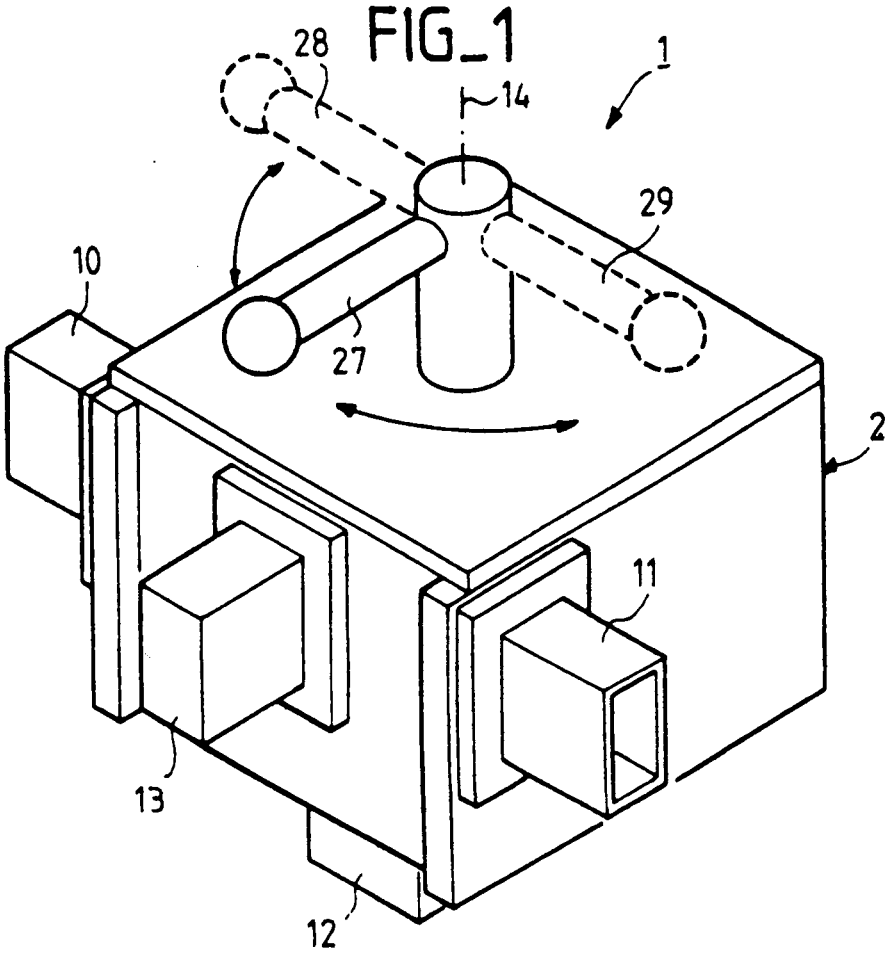
FIG. 1 is an external view in perspective of a coupling device between two microwave energy sources according to the invention.
Figure 3:
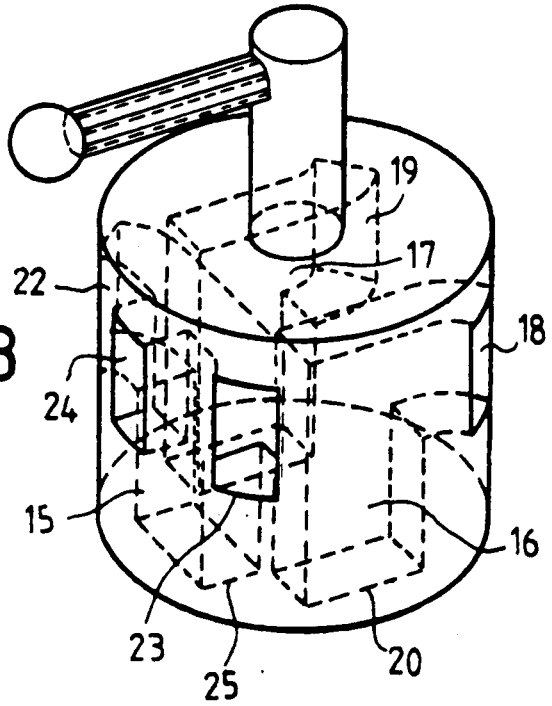
FIG. 3 is a view in perspective of the plug in which the internal conduits are shown in dots and dashes.
Figure 2:
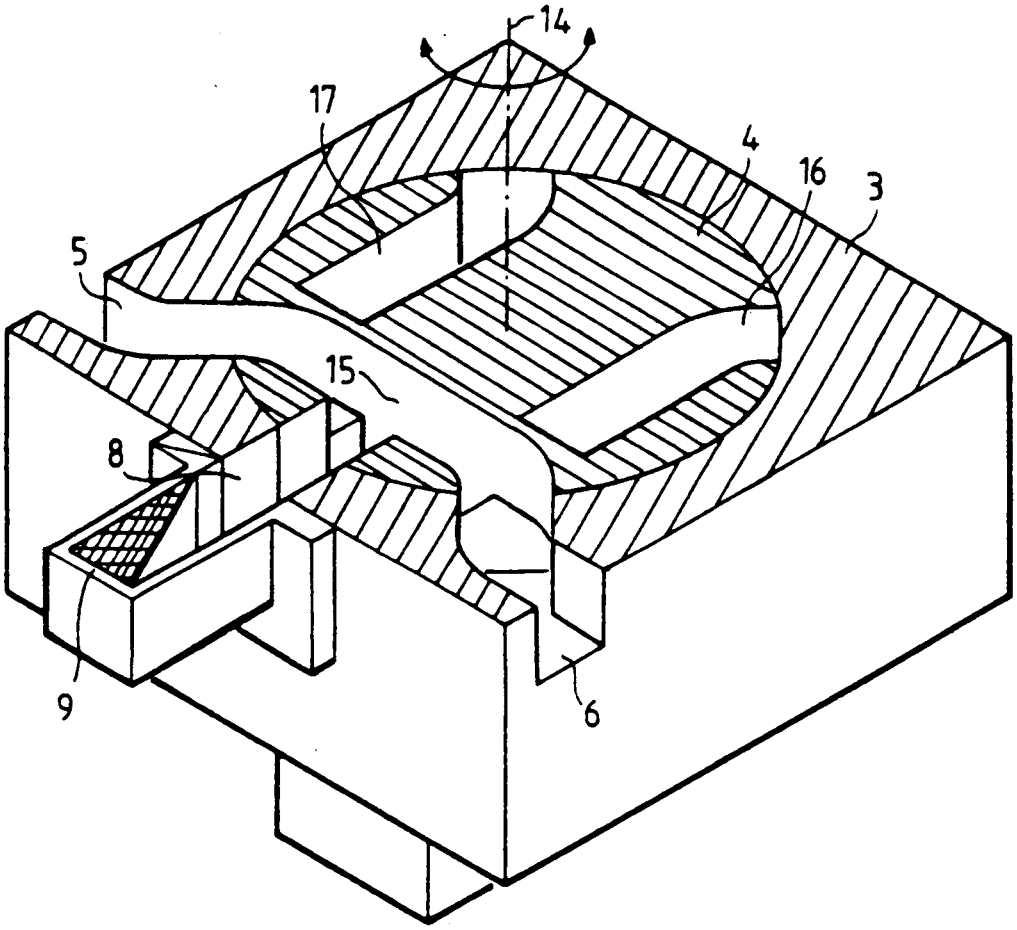
FIG. 2 is a sectional view of the coupling device in a plane perpendicular to the axis of rotation 14 of the plug.

As can be seen in FIGS. 1, 2 and 3, a coupling device 1 between two microwave energy sources (not shown), for example two emitters, essentially comprises a box 2 having a fixed external part 3 and an internal cavity within which a plug 4 can rotate. The external part 3 and the plug 4 have different conduits which can communicate with one another selectively, depending on the angular position of the plug 4 with respect to the external part 3.

This external part 3 has four conduits, 5, 6, 7 and 8. A first conduit 5 is designed to be connected to a first emitter, and a second conduit 6 is designed to be connected to a second emitter. These two conduits form the inputs of the coupling device. The two outputs are formed by a third conduit 7 (FIG. 6) which adds up the signals applied to the inputs and a fourth conduit 8 which is connected to a load 9. The output holes of these conduits 5, 6, 7 and 8 are respectively provided with connecting waveguides 10, 11, 12 and 13, the guide 13 receiving the load 9.

The plug 4 has the shape of a cylinder generated by revolution with a circular section that rotates on its own axis of symmetry 14. The cylinder is solid and has three internal conduits 15, 16 and 17, separated from one another. Each conduit 16 or 17 has two ends that open out on to the exterior of the plug by holes located in different planes. One of the holes 18 or 19 is located on the cylindrical surface, while the other hole, 20 or 21, is located in a plane 26 perpendicular to the axis 14. The conduit 15 has three holes 22, 23 and 24 which open out on to the cylindrical surface, and a fourth hole 25 which opens out on to the perpendicular plane 26.

The conduits 16 and 17 have a general shape approaching that of an upside down capital L with its vertical stroke, parallel to the axis 14, corresponding to the hole 20 or 21, and its horizontal base corresponding to the hole 18 or 19. Moreover, the horizontal base is slightly incurvated so that the hole 18 or 19 is located substantially in a plane perpendicular to an axial plane going through the middle of the hole.

The conduit 15 has the general shape of a magic T circuit, and its direction is such, at the holes 22, 23 and 24, that these holes are each located in a plane perpendicular to an axial plane going through the middle of the hole.

The rotation of the plug 4 on the axis 14 is obtained by a handle 27 or an electromechanical control which is fixedly joined to the plug. This rotation enables the setting up of communication among the external conduits 5, 6, 7 and 8, or only some of them, depending on the position of the handle 27, that is, the position of the plug 4.

In the position of the plug 4, such as it appears in FIGS. 1, 2, 3, 4 and 5, the input conduits 5 and 6 communicate with the output conduits 7 and 8 so as to form a magic T junction.

Figure 6:
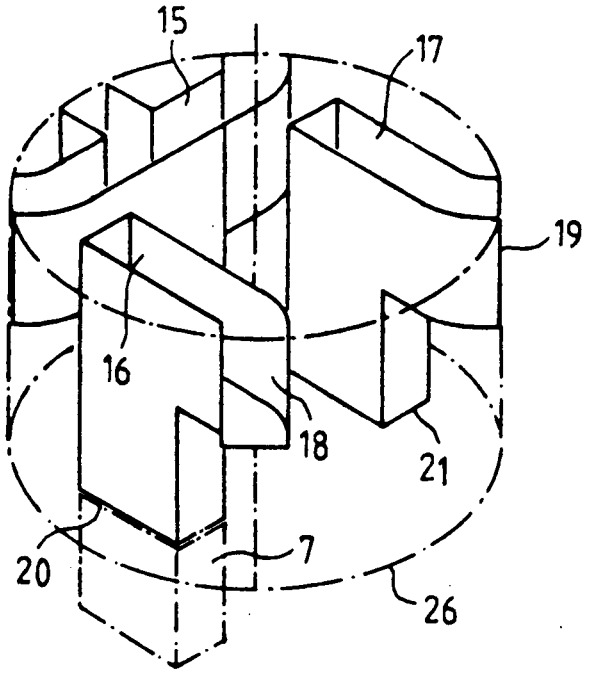
FIG. 6 is a view in perspective of the different relative positions of the conduits of the plug when one of the energy sources is malfunctioning.
Figure 4:
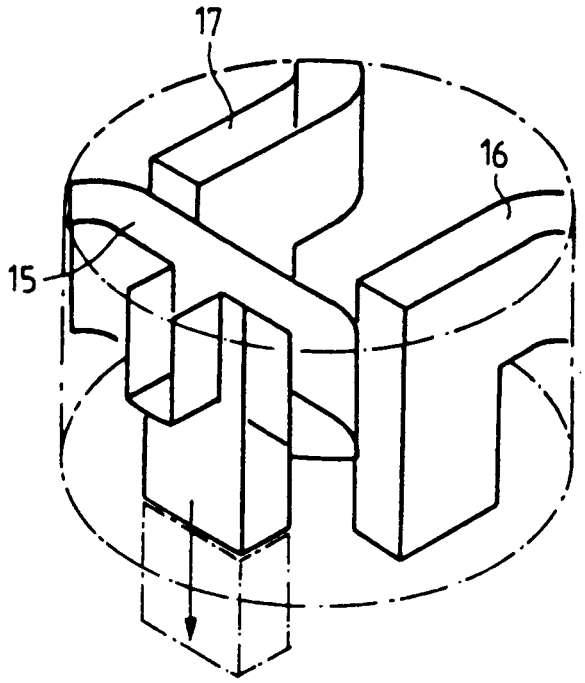
FIG. 4 is a view in perspective of the different relative positions of the conduits of the plug to obtain the coupling of the energy sources.
Figure 5:
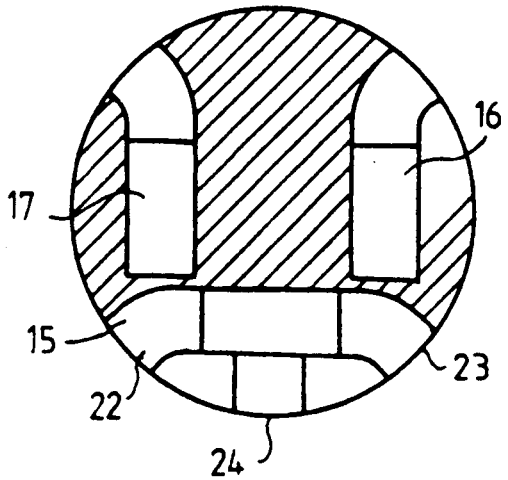
FIG. 5 is a sectional view of the plug in a plane perpendicular to its axis of rotation 14 in the example of the coupling of two energy sources.

In the position of the plug 4, such as it appears in FIG. 6, the input conduit 6 communicates only with the conduit 7 so that all the power of the signal applied to the input 6 is recovered at output in the conduit 7. This position, with the handle in the position 28 (FIG. 1), is used when the emitter connected to the conduit 5 is malfunctioning.

It can be understood that if the handle is in the position 29 (FIG. 1), only the conduit 5 is connected to the conduit 7 so that all the power of the signal applied to the input 5 is recovered at output in the conduit 7. This position, with the handle in this position is used when the emitter connected to the conduit 6 is malfunctioning.

The material used to make the coupling device according to the invention may be of any type implemented in the waveguides.

The description that has just been given is restricted to what was necessary to understand the invention and thus enable it to be made by any person skilled in the art. It is thus that no mention was made of the mechanical details of the fabrication and assembly of the different elements forming the coupling device, for these aspects are within the scope of those skilled in the art, all the more so as plug-type microwave switches are known.

The coupling device described in relation to FIGS. 1 to 6 enables the coupling of two emitters of the same power. When the emitters deliver power of very different values from each other, for example in the ratio of ½, the signals from the emitters have to be combined in a certain way in a modified magic T junction. In the coupling device according to the invention, this amounts to modifying the structure of the conduit 15 of the plug 4, while the other conduits 16 and 17 remain unchanged.

Figure 7:
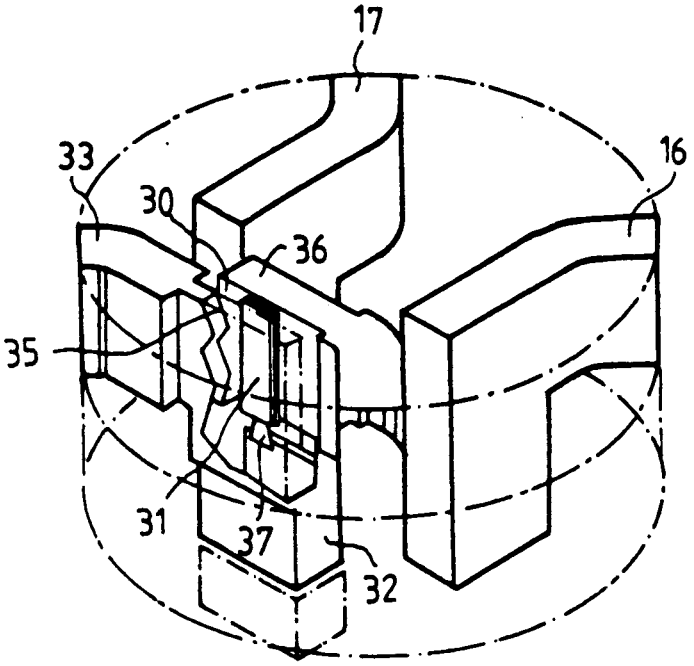
FIG. 7 is a view in perspective of an exemplary embodiment of a plug according to the invention when the power values of the microwave energy sources are not equal.
Figure 8:
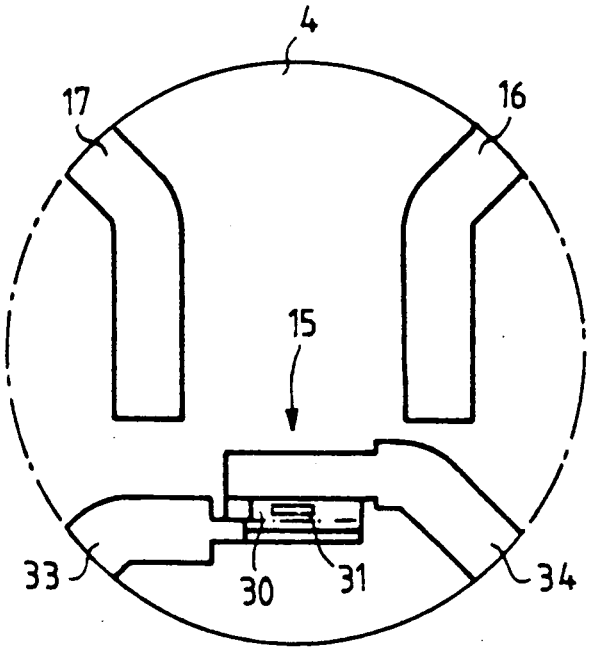
FIG. 8 is a sectional view of the exemplary embodiment of FIG. 7 in a plane perpendicular to the axis of rotation of the plug.

FIGS. 7 and 8 are views of a particular exemplary embodiment of a plug that enables the coupling of two emitters, one of which has a power value which is twice that of the other. To this effect, the internal conduit 15 is modified to obtain an efficient coupling inside the magic T junction. This coupling is obtained by a guide/strip line device 31 placed between the two input conduits of the microwave signals. These input conduits bear the references 33 and 34 and are, respectively, the extension of the conduits 5 and 6 of the external part 3 (FIG. 2), the conduit 6 being connected to an emitter with a power value that is twice that of the one connected to the conduit 5.

The conduits 33 and 34 end, at the central part of the conduit 15, in two chambers 35 and 36 which have a common partition wall 30 that supports the above-mentioned guide/strip line device 31. These two chambers are opened only towards the input conduits 33 and 34 and towards a common output conduit 32 that corresponds to the output of the magic T junction. The transverse dimensions of the chambers 35 and 36 are substantially in the ratio of ½ to take into account the ratio between the values of the power applied to them.

The upper end of the strip line is connected to a load, not shown in FIGS. 7 and 8, by means of a coaxial line for example. Since this load is fixedly joined to the plug 4 through the coaxial line and since it can go beyond the periphery of the plug, the fixed part 3 must have a groove (not shown) for the housing of this load during the rotation of the plug.

The lower end of the strip line ends in an adapter 37 placed in the output conduit 32. This adaptor is, for example, of the so-called "door-knob" type.

The working of the coupling device according to the invention in the example of the plug of FIGS. 7 and 8 is identical to the one described earlier. Thus, in the position shown in FIGS. 7 and 8, the respective power of the emitters gets added up at the output 32. In the event of malfunctioning, the plug is rotated so as to directly couple the input connected to the working emitter to the output and to disconnect the input connected to the malfunctioning emitter.

Of course, coupling devices other than the one that has just been described can be contemplated without going beyond the scope of the present invention.

What is claimed is:

1. A device for the selective connecting of two sources of microwave signals to a device for the using of said microwave signals, comprising a fixed external part and a cylindrical plug element rotating within said external part in close contact with said external part, said fixed external part comprising two input conduits, each connected to one of said sources, and two output conduits, respectively connected to a load and to a device for the using of the microwave signals, said output conduit connected to a device being located substantially in a plane perpendicular to the plane defined by said input conduits and said output conduit connected to a load, said cylindrical plug comprising three internal conduits that are separated from one another, and being able to take at least three positions, depending on the angular position of said plug with respect to said external part, enabling:

in a first position, the connection of said two sources to said two outputs, with the help of a first internal conduit, so as to realize a magic T junction, enabling the adding up of the signals of said sources, in a second and third position, the connection of only one of said sources to said output connected to said device, with the help of respectively a second and third internal conduit, and the disconnection of said output connected to a load so as to prevent any loss of power.

2. A device according to claim 1 wherein said internal conduits have a slightly incurvated shape so that each end of said internal conduits to be in contact with said input conduits is located substantially in a plane perpendicular to an axial plane going through the middle of said end.

* * * * *